United States Patent [19]

Guyon

[11] Patent Number: 5,022,302

[45] Date of Patent: Jun. 11, 1991

[54] DAMPER MECHANISM FOR UPRIGHT PIANO

[76] Inventor: Vincent Guyon, 9, rue Joseph Demaistre, 75018 Paris, France

[21] Appl. No.: 481,226

[22] Filed: Feb. 20, 1990

[30] Foreign Application Priority Data

Feb. 22, 1989 [FR] France ..... 89 02309

[51] Int. Cl.[5] ..... G10C 3/18

[52] U.S. Cl. ..... 84/255

[58] Field of Search ..... 84/217, 218, 255, 240

[56] References Cited

U.S. PATENT DOCUMENTS

| | | | |
|---|---|---|---|
| 179,029 | 6/1876 | Koth | 84/253 |
| 204,752 | 6/1878 | Neill | 84/240 |
| 426,332 | 4/1890 | Schaaf | 84/240 |
| 896,763 | 8/1908 | Schimmel | 84/240 X |
| 1,104,282 | 7/1914 | Severy et al. | 84/217 X |
| 4,854,211 | 8/1989 | Tanaka et al. | 84/240 |

FOREIGN PATENT DOCUMENTS

| | | | |
|---|---|---|---|
| 10729 | 9/1880 | Fed. Rep. of Germany | 84/255 |
| 74725 | 9/1892 | Fed. Rep. of Germany . | |
| 73461 | 2/1893 | Fed. Rep. of Germany . | |
| 97885 | 10/1897 | Fed. Rep. of Germany . | |
| 107352 | 12/1898 | Fed. Rep. of Germany . | |
| 2155211 | 5/1973 | Fed. Rep. of Germany . | |
| 3139404 | 6/1983 | Fed. Rep. of Germany . | |
| 3730100 | 5/1988 | Fed. Rep. of Germany . | |
| 1334396 | 4/1902 | France . | |
| 1568766 | 4/1902 | France . | |
| 638797 | 6/1928 | France . | |
| 707266 | 7/1931 | France . | |
| 1453851 | 9/1966 | France . | |
| 1556671 | 2/1969 | France . | |
| 2251064 | 6/1975 | France . | |
| 2288364 | 5/1976 | France . | |
| 2542120 | 11/1986 | France . | |
| 2564628 | 12/1986 | France . | |
| 58-108496 | 7/1983 | Japan . | |
| 226616 | 1/1925 | United Kingdom . | |
| 332328 | 7/1930 | United Kingdom . | |

*Primary Examiner*—Brian W. Brown

*Attorney, Agent, or Firm*—Hoffman, Wasson & Gitler

[57] ABSTRACT

The invention relates to a damper mechanism for upright piano, comprising a damper felt mounted on a damper wood, and in which the damper wood is equipped with a guide stem directionally adjusted perpendicularly to the plane of the strings and guided to move reciprocally in a bore of a block fixed on a support independent of the mechanism controlling the hammers. Members are interposed between the key and the damper guide stem for reciprocally moving the latter in response to the movement of the key.

12 Claims, 6 Drawing Sheets

80
120
126
102
122
78
94
144
118
100
10
II
108
138
140
14
76
74
72
70
142
92
82
88
68
204
48
46
66
56
86
108
40
64
42
89
44
73
90
60
58
30
50
18
110
38
62
52
28
31
36
54
34
32
26
134
12
16
20
24
22
24
II 80
120
126
128
102
122
116
124
130
78
94
112
114
144
132
118
100
10
II
136
108
106
140
14
76
74
72
70
138
92
82
88
68
142
48
46
56
66
86
104
40
64
42
106
89
44
73
108
90
60
58
30
50
18
110
38
62
52
28
31
36
54
34
32
26
134
12
16
20
24
22
24
II 14
80
116
78
114
112
126
120
144
118
140
142
138
76
74
66
86
89
73
106
30
31
32
110
26
134
12
24
22

200
102'
144
14
134
22

DAMPER MECHANISM FOR UPRIGHT PIANO

FIELD OF THE INVENTION

The present invention relates to a damper mechanism for upright pianos.

BACKGROUND OF THE INVENTION

Since conventional piano actions for upright pianos do not provide the same interpretation possibilities as grand piano actions do, attempts have been made to adapt onto upright pianos, actions which are derived from those of grand pianos, as taught for example in British Pat. No. GB 226 616.

Until now, however, there has been no successful attempt to design damper mechanisms for upright pianos which provide all the advantages of the damper mechanisms used in grand pianos, i.e.

actuation by the key itself return by gravity, without springs displacement exactly perpendicular to the strings arrangement on support bars fully independent from the keys and from the hammer mechanism, and moreover, these mechanisms should be accommodated within the space between the hammer mechanisms and the strings.

Only document DE 97 885 proposes a solution bringing certain of the aforesaid advantages:

actuation by the key itself return by gravity, without springs accommodation of the mechanisms within the space between the hammer mechanisms and the strings but the displacement of the damper blocks follows an arc of circle, and is not exactly perpendicular to the strings.

SUMMARY OF THE INVENTION

It is the object of the present invention to provide a damper mechanism for upright pianos, of the type having supports independent of the hammer mechanism and being implanted between the latter and the string, said damper mechanism being controlled by a key and comprising an elongated damper block positioned along the string and held by a damper; characterized in that it comprises a rigid guide stem fast with the damper wood and directionally adjusted perpendicularly to the string; a support block provided with a hole of cross-section complementary to said stem and forming guide for the latter, members being interposed between the key and the guide stem for reciprocally moving the latter in response to the switching over of the key.

Thus, displacement of the damper block is perpendicular to the string, which prevents the disadvantages of a displacement according to an arc of circle.

Preferably, the members interposed between the key and the guide stem of the damper block have no return springs, in order not to affect the touch of the piano.

Advantageously, said members comprise a substantially vertical loaded stem movable upwardly via the key and a rocking member between the top of said loaded stem and the damper block guide stem.

As a variant, the device interposed between the key and the damper block guide stem may consists in an electromagnetic device, or in a hydraulic or pneumatic device.

BRIEF DESCRIPTION OF THE DRAWINGS

The invention will be more readily understood on reading the following description, with reference to the appended drawings, in which.

DETAILED DESCRIPTION OF PREFERRED EMBODIMENT

Figure 1A:
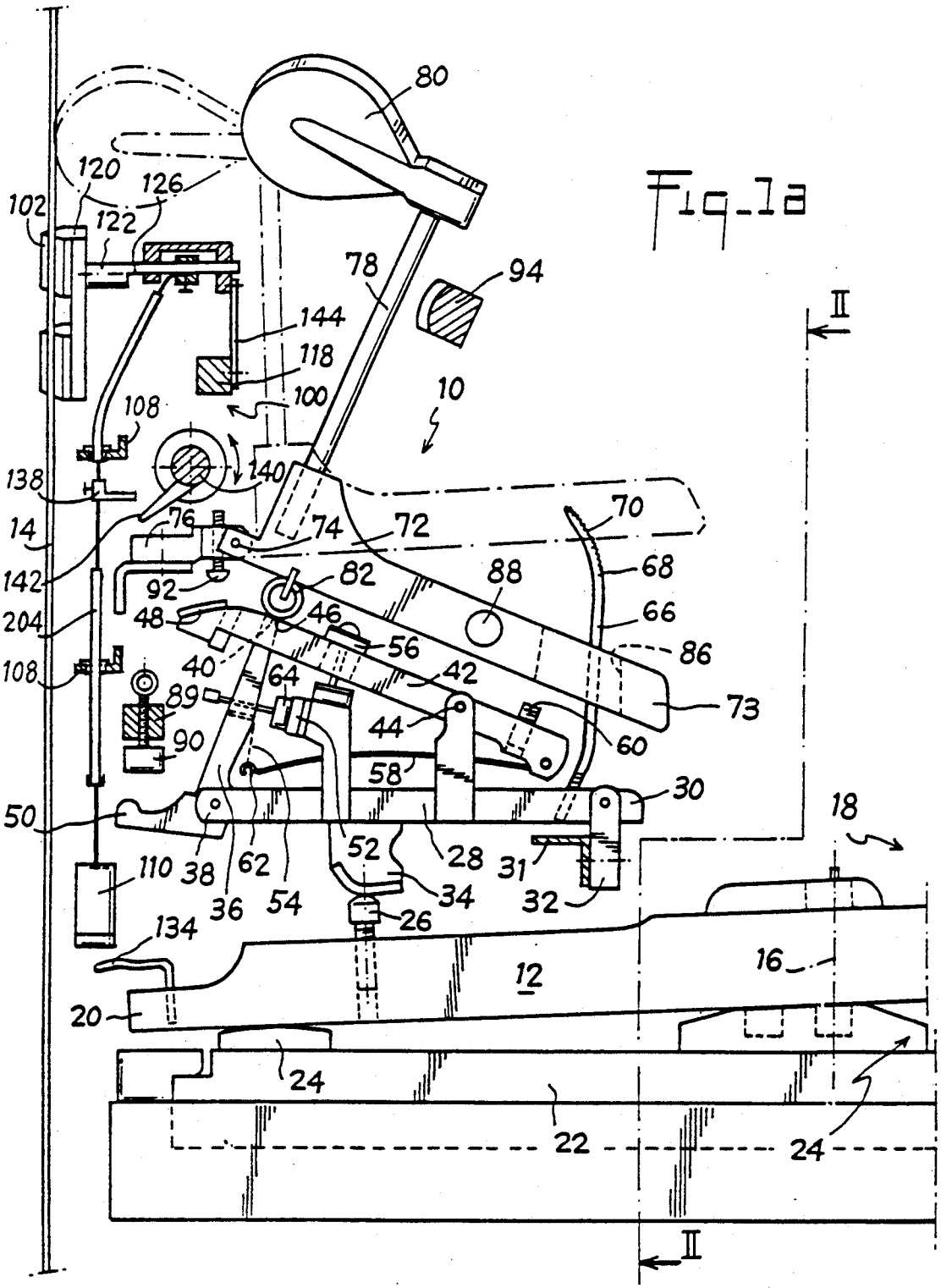
FIG. 1*a* is a side view of a second embodiment of the upright piano mechanism equipped with a damper mechanism and a sheathed cable.
Figure 1:
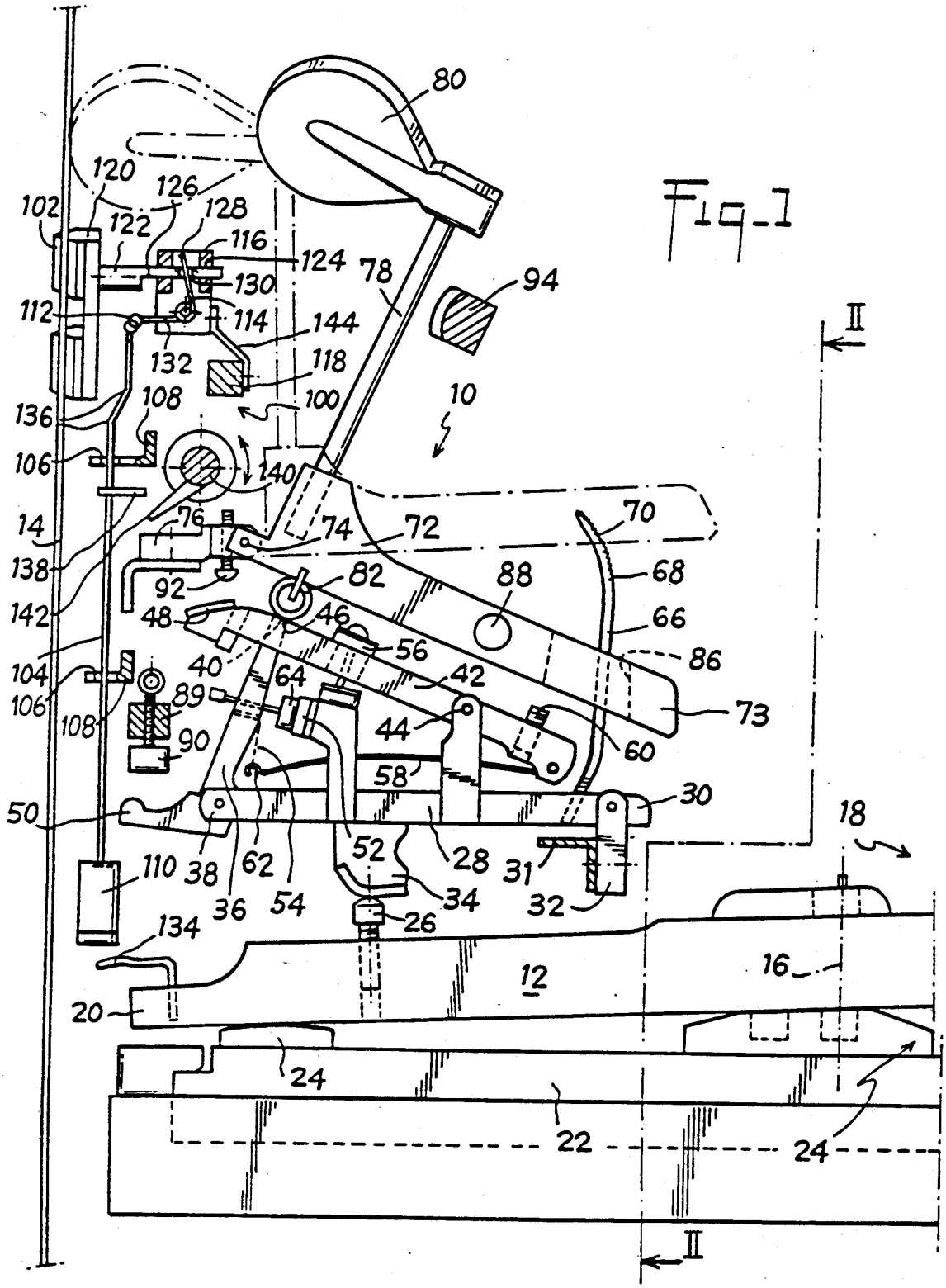
FIG. 1 is a side view of an upright piano mechanism equipped with a damper mechanism according to the invention.
Figure 2:
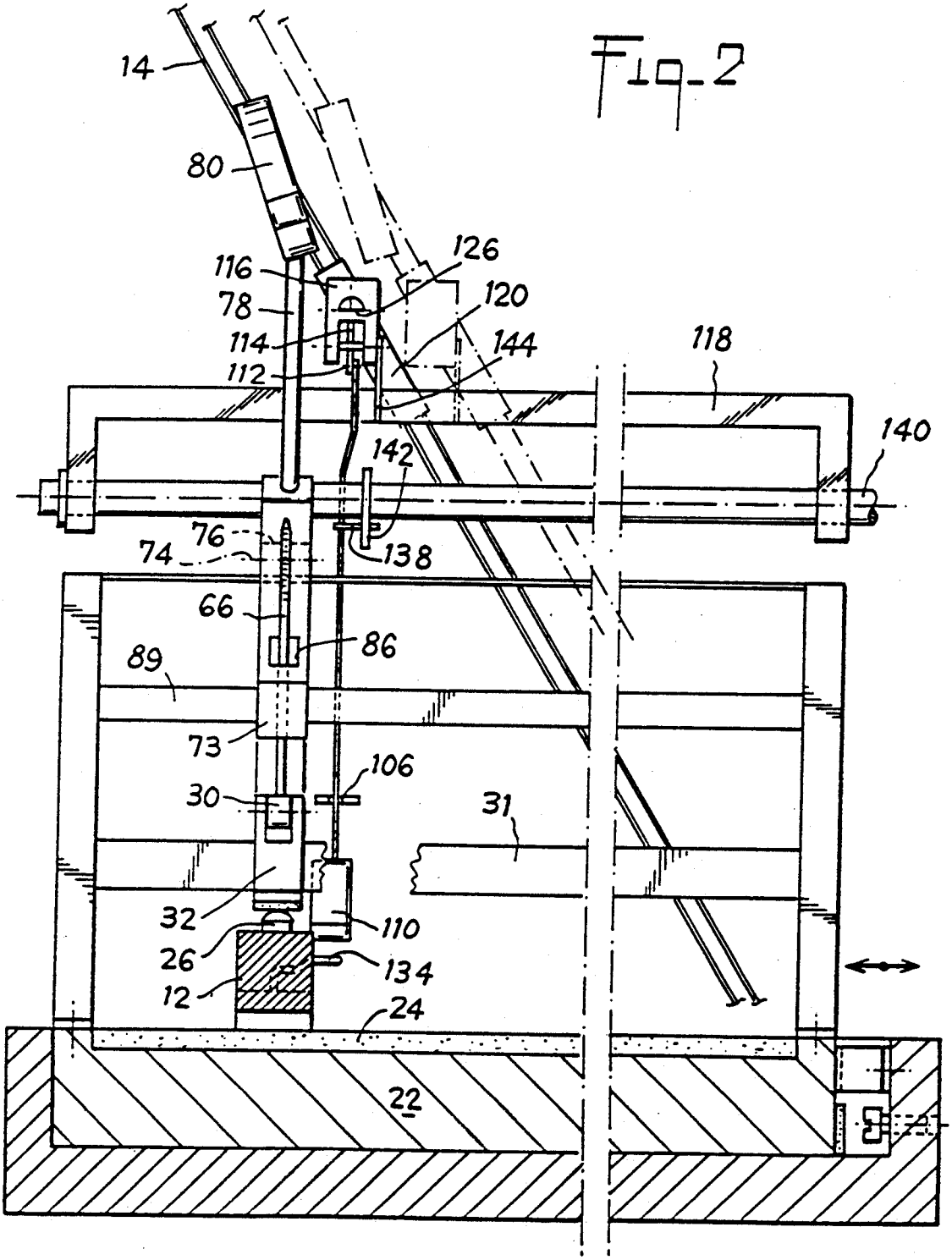
FIG. 2 is a front view of part of the mechanism illustrated in FIG. 1.

The hammer actuating mechanism 10 shown in side view in FIG. 1 is operationally coupled to a key 12 and to a string 14 or group of strings of the same key, situated in a vertical plane, given that the string, or group of string, can extend within said plane in an inclined direction with respect to the vertical.

Understandably, there will be in the piano, as many mechanisms 10 as there are keys 12, or strings or groups of strings 14.

Key 12 extends substantially horizontally and pivots about a transversal axis 16 in such a way as to present a hand-operatable end 18, situated on the righthand side of the figure, and and an actuating end 20 on the lefthand side, i.e. on the side of the plane of strings. Damping pads 24, made of felt, are fixed on the key bed 22 and under the two ends of the keys, in order to prevent noises when the key contacts with the bed.

The key 12 is provided, close to its lefthand end, with a capstan screw cooperating with a lever, also called whippen, 28, disposed in parallel to and above the key 12, and pivotally mounted by its righthand end 30, when looking at the figure, i.e. by its end remote from the plane of strings, on a transversal whippen flange 32 fixed on the piano frame.

The whippen 28 has a whippen heel 34, padded with felt and in contact with the capstan screw 26 of the key 12.

At its upper part, the whippen 28 is equipped, on the one hand, with a jack 36, pivotally mounted substantially at the end 38 of the whippen and generally extending upwardly, said jack ending at its upper end, with a thrusting end surface 40; and on the other hand, with a repetition lever 42 pivotally mounted in 44 on the whippen and inclined upwardly to the left substantially perpendicularly to the jack 36, thus presenting an upper bearing surface 46 situated at the same level as the thrusting surface 40 of the jack, and a felt-covered stop end 48.

The jack 36 comprises a jack tail 50 which extends substantially horizontally beyond the end of the whippen 28.

Said whippen 28 carries a first rear stop 52 against which abuts the jack 36 under the action of a return member 54, and a second upper stop 56 against which abuts the repetition lever 42 under the action of a repetition spring 58.

The repetition spring and the return member are either independent or form a combined assembly as illustrated: the spring 58 of repetition lever 42 being fixed on one end of said repetition lever via an adjusting member 60, and having a distal end 62 shaped as a hook to receive the end of a strip 54 fastened to the jack.

Adjustment of the stop positions of the jack and of the repetition lever is achieved:

for the jack, by adjusting a bearing member 64 fixed thereon, and for the repetition lever, by adjusting the stop 56 proper.

Finally, whippen 28 comprises, between its pivot point 30 and that 44 of the repetition lever 42, a back check 66 in the form of a vertical stem bent at its upper part 68 and having a rough surface 70 on its outside part, i.e. on its side facing away from the plane of strings.

Above the repetition lever, a hammer butt 72, pivotally mounted in 74 on a rail 76 mounted on the frame, extends to the right, on the side of the plane of strings, according to an inclination substantially parallel to the repetition lever 42. The butt 72 carries an upwardly directed hammer shank 78 ending with a conventional hammer 80, inclined so as to form with the shank an angle equal to the inclination of the string or group of strings which the hammer has to strike.

Under the hammer butt 72 is fixed a felt-covered knuckle 82 resting both on the end bearing face 46 of the jack 36 and on the upper face 46 of the repetition lever 42.

The hammer butt 72 comprises an extension 73 extending to the right and provided with a through hole 84 traversed by the back check 66, the hole has a surface 86 forming a catcher lined with felt and designed to cooperate with the rough surface 70 of the back check 66. The hammer butt 77 further comprises a recess for receiving the balancing load 88, normally a balancing load made of lead, the weight of which is so selected as to exert on the key 12, via the knuckle 82, the jack 36 and the whippen 28, a force identical to that which would be exerted by a hammer of similar size in a grand piano.

Under the hammer rail 76, a regulating button 90, covered with felt, is fixed in facing relationship to the jack tail 50, whereas a drop screw 92 is fixed in facing relationship to the distal stop end 48 of the repetition lever 42, the position of both button 90 and drop screw 92 being adjustable.

On the righthand side of the hammer shank 78 and at a short distance therefrom, there is mounted a hammer rail 94, covered with felt and fixed with respect to the frame, said rail being designed to prevent the hammer 80 from going beyond a predetermined position after rebounding on the string 14.

A damper mechanism 100 is mounted immediately below the hammer, which mechanism is composed of a conventionally shaped felt block 102 and is actuated by a device which raises the felt block in parallel to the plane of strings 14.

According to the invention, the actuating device comprises a vertical loaded actuating rod 104, guided by eyelets 106 mounted on rails 108 which are fixed with respect to the frame. The actuating rod 104 ends at its lower part with a load 110 situated above the left-hand end 20 of the key 12 and at its upper part with a hook or articulation 112 cooperating with a rocking member 114 pivotally mounted on a damper block 116, which latter is fixedly mounted on a mounting support 118, attention being drawn to the fact that supports 108 and support 118 are independent of the supports of the mechanisms actuating the hammers.

The position of the load 110 on the actuating rod 104 can of course differ from that illustrated and described herein. For example, if the overall volume dimensions of the hammer actuating mechanism allows it, the load can be placed in the vicinity of the upper end of the rod, at a short distance under articulation 112. As a variant, the rod may be extended under the key bed and the load may be fixed under the ends of the keys. The rod will then carry an adjustable button above the actuating end of the key which button will be urged upwardly by a spoon fixed on the key.

The damping felt 102 is fixed to a damper wood 120 from which projects a guide stem 122 perpendicular to the felt block and to its damper wood.

Support block 116 fixed to the rail 118 comprises a horizontal bore 124 through which the guide stem 122 can slide closer to or away from the plane of strings, in such a way that the damping felt 102 remains parallel to the strings 14. The guide stem 122 is essentially cylindrical and comprises anti-rotation means in order to prevent any misalignment of the damping felt 102 with respect to the strings 14.

In the illustrated embodiment, said anti-rotation means consists in a notch 126 made in the guide stem, through half its thickness and over part of its length, bore 124 having a complementary halfmoon-shaped cross-section.

The rocking member 114, mounted for pivoting on the support block, comprises a substantially vertical arm 128 traversing a slot 130 provided in the guide stem, and a substantially horizontal arm 132 on the end of which is suspended the vertical actuating rod 104.

Given that the damping felt 102 is not normally placed vertically above the key 12 but is, on the contrary, shifted forward or rearward with respect to the plane of the figure, and given that the support block 116 is further away from the plane of the strings 14 than the thrusting spoon 134, the actuating rodis bent in 136 so that its upper end situated at the level of articulation 112 is shifted of the necessary distance in the two directions.

In order to lift the damper 102 by actuating the "sostenuto" pedal, the rod 104 carries a lug 138 projecting to the right and a control bar 140 with a lateral tip 142 is mounted for pivoting about its axis on the piano frame, via a suitable mechanism connected to the pedal. Control bar 140 pivots from a rest position, illustrated in the figure, in which the lateral tip 142 of the bar is facing downwardly, to a work position after pivoting clockwise of a quarter of a turn, in which work position the lateral tip 142 raises the lug 138 of the actuating rod 104, thus moving the damping felt 102 away from the strings independently of the position of the key.

Advantageously, the support block 116 of the damper is mounted on its support 118 via an arm 144 with possibility of adjustment in several directions, particularly with a view to adjusting the parallelism of the damping felt 102 with respect to the plane of the strings 14 and its lateral position with respect to the strings. In particular, the mounting arm 144 will be constituted of a deformable wire in order to allow said adjustments by simple deformation of said wire.

It will be noted that the damper mechanism asesembly 100 is independent of the mechanism 10 controlling the hammers, which simplifies production, assembling, mounting on the piano, and adjustments of said mechanism.

Moreover, the damping felts 102 move closer to and away from the strings while remaining parallel to them, as is the case in a grand piano. The detaching from and contacting with the strings are operated outright throughout the length of the felt and over a very short stroke.

It is also possible to provide damping felts which are considerably longer than those normally used in the conventional upright pianos, and as long as those used in grand pianos, which will improve their efficiency.

The damper mechanism contains no springs, only a simple load, thus ensuring a reaction to the touch which is identical to that obtained with a damper mechanism for grand pianos, without elastic effect.

As a variant, but at the expense of a slight loss of touch quality, the load 110 can be omitted and return of the damping felt 102 can be achieved with a spring, which will be for example placed about the guide stem 122, between the damper wood 120 and the support block 116.

Finally, as the damper mechanism is independent of the mechanism 10 controlling the hammers, it may be advantageously provided for the latter to be mounted with a possibility of lateral translation, thanks to which the sound volume can be dampened by actuating the "unacorda" pedal. In this case, the hammer 80 only strikes on part of the strings of each group of strings 14.

This is also made possible by the fact that the thrusting spoon 134 at the end of the key 12 is situated under the lower face of the load 110, the width of which is sufficient to allow such a lateral translation of the key.

This eliminates all the problems linked to the solutions normally applied in upright pianos and which consist in raising back up the hammer rail of the hammer bound when the "unacorda" pedal is actuated, thus limiting the spring of the hammers, but at the time introducing a certain play in the mechanism, which is bad for the quality of the touch.

The mechanism actuating the hammers works as follows:

The key 12 is pressed down by its righthand end 18, the lefthand end 20 is then raised, and causes the whippen 28, the jack 36 and the repetition lever 42 to pivot together clockwise and upwardly about the axis of the whippen 28.

The rising movement of the jack 36 is transmitted to the butt 72 of the hammer via the knuckle 82, so that the hammer butt 72, the shank 78 and the hammer 80 pivot together anti-clockwise about the hub axis 74, with a certain bound so that the hammer 80 continues its stroke until it strikes the string 14 and returns under the conjugated effect of rebound and restoring torque exerted by the balancing load 88.

A certain rotation of the whippen 28 brings the jack tail 50 in contact with the regulating button 90, thus causing the pivoting of said jack in anti-clockwise direction and the lateral shifting of its end face 40 with respect to the knuckle 82 of the hammer butt 72.

Substantially simultaneously, the stop end 48 of the repetition lever 42 contacts with its drop screw 92, this immediately stopping the movement of said lever.

While the righthand end 18 of the key is pressed down and its lefthand end 20 is raised, the spoon 134 raises the load 110 and, as a result, the damper actuating rod 104. The rising movement of the latter causes the pivoting movement of the rocking member 114 and the vertical arm 128 of the latter pulls the guide stem 122 of the damper to the right, thus moving the damper felt 102 away from the strings 14. The felt is then completely detached in a very short stroke.

Once the hammer 80 has struck the string or strings 14, it returns in the opposite direction, the butt 72 of the hammer pivoting clockwise until its knuckle 82 returns to a position in contact with the top 46 of the repetition lever 42, the fact being noted that the return of hammer 80 is positively ensured by the balancing load 88 fixed on the butt 72, even if the initial bound of the hammer 80, hence its rebound, is extremely low.

Depending on the return power of the hammer, the knuckle 82 urges down more or less the repetition lever 42, against its repetition spring 58 until the hammer 80 and its butt 72 are immobilized in a return position.

If the bound imparted to the hammer is low, its return power is also low and the return position corresponds to a simple dampened return of the butt 72 of the hammer to rest against the top 46 of the repetition lever 42, the latter being held back by the drop screw 92.

If the bound imparted to the hammer is higher, its return power is also higher and the sinking down of the repetition lever 42 against its repetition spring 58 can be such that the catcher 86 of the butt 72 of the hammer engages the back check 66, 70 of the whippen 28. The friction between the back check 70 and the catcher surface 86 stops abruptly the butt 72 and the hammer 80 in a lift position in which the repetition lever 42 is slightly sunk.

When the key is completely released, the different parts of the mechanism return to their starting positions as illustrated in the figure and described hereinabove.

To play again the note, the mechanism works as follows: in the starting position, the righthand end 18 of the key is pressed down and the butt 72 of the hammer is back to its above-described return position.

Key 12 is released slightly, its end 18 thenrising slightly, whereas its lefthand end 20 is sinking down slightly; as a result, the whippen 28 pivots to the left, and in doing so moves away from the catcher 86 of the hammer butt 72; consequently, the repetition spring 58 of the repetition lever 42 urges the latter upwardly together with the hammer butt 72, until the repetition lever 42 abuts against the drop screw 92, the repetition lever 42 and the hammer butt 80 then occupying the same return position as that which they would have occupied after a first low-powered stroke.

At the same time, the downward movement of the whippen 28 carries that of the jack 36; the jack tail 50 of moves away from the regulating button 90 and the return member 54 of the jack 36 urges the latter to the right as shown in FIG. 1, this enabling the end 40 of the jack 36 to resume its starting position under the knuckle 82 of the hammer butt 72.

The note can then be replayed, without the need of releasing completely the key 12.

It is to be noted that the mechanism described hereinabove is on the whole related to the grand piano mechanisms and procures the same qualities of touch.

Nevertheless, it presents the following essential characteristics over the other mechanisms:

the whippen pivoting direction is reversed the shank of the hammer is directed substantially vertically instead of being directed substantially horizontally and the hammer butt carries a balancing load the damper mechanism comprises a guide stem in order to allow for the vertical orientation of the plane of strings.

It is understood that the mechanism described in the foregoing comprises the necessary adjustment members which are known to anyone skilled in the art.

And anyone skilled in the art will also note that virtually all the types of whippens usable in grand pianos can be used in the present invention.

Moreover, the two parts of the key which extend on either side of the key's pivoting axis may be given proportions which are equal to those observed in grand pianos.

It will finally be noted that the damper mechanism assembly according to the invention is adaptable to most upright pianos which are equipped with the conventional hammer mechanisms.

Figure 3:
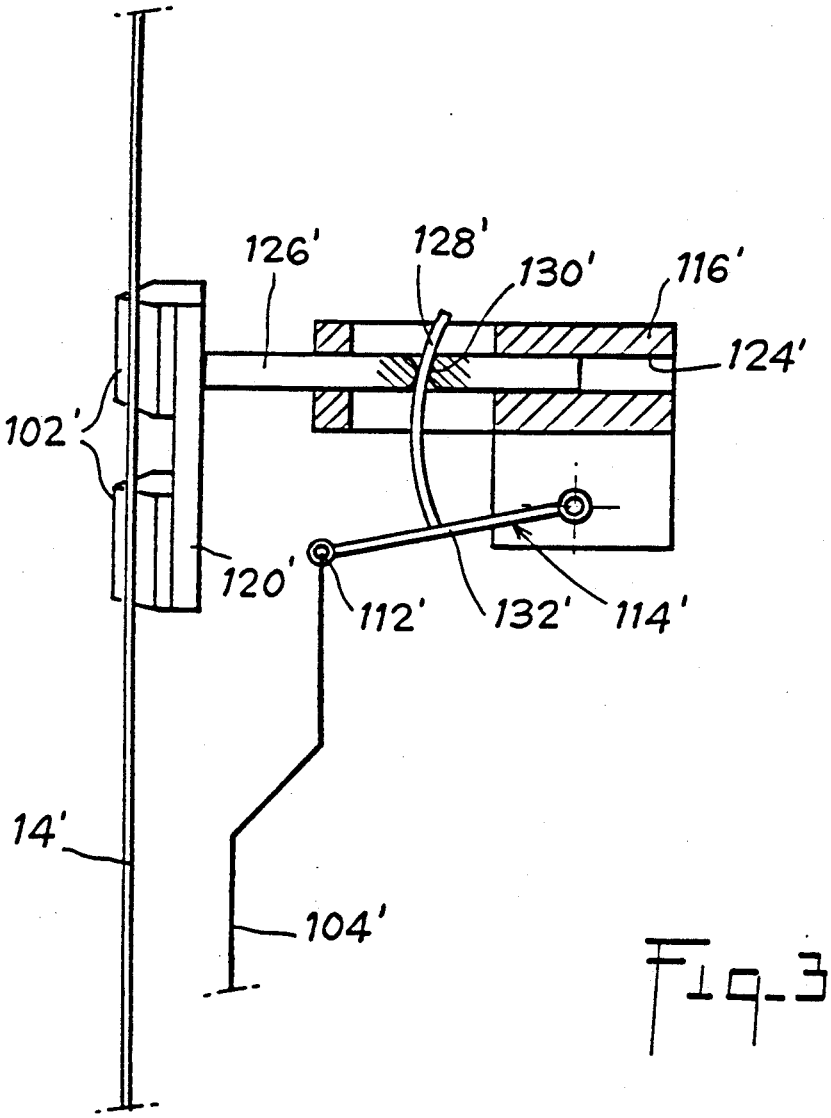
FIG. 3 is a detailed view of a variant embodiment of the damper mechanism.

According to a variant illustrated in FIG. 3, the vertical arm 128' of the jack tail 114' is fixed on its horizontal arm 132' and has a bent shape in order to improve the transmission of the movement between the rocking member and the guide stem 122' of the damper.

According to another variant, not shown, a connecting rod is provided between the vertical arm of the rocking member and the guide stem of the damper.

Figure 3A:
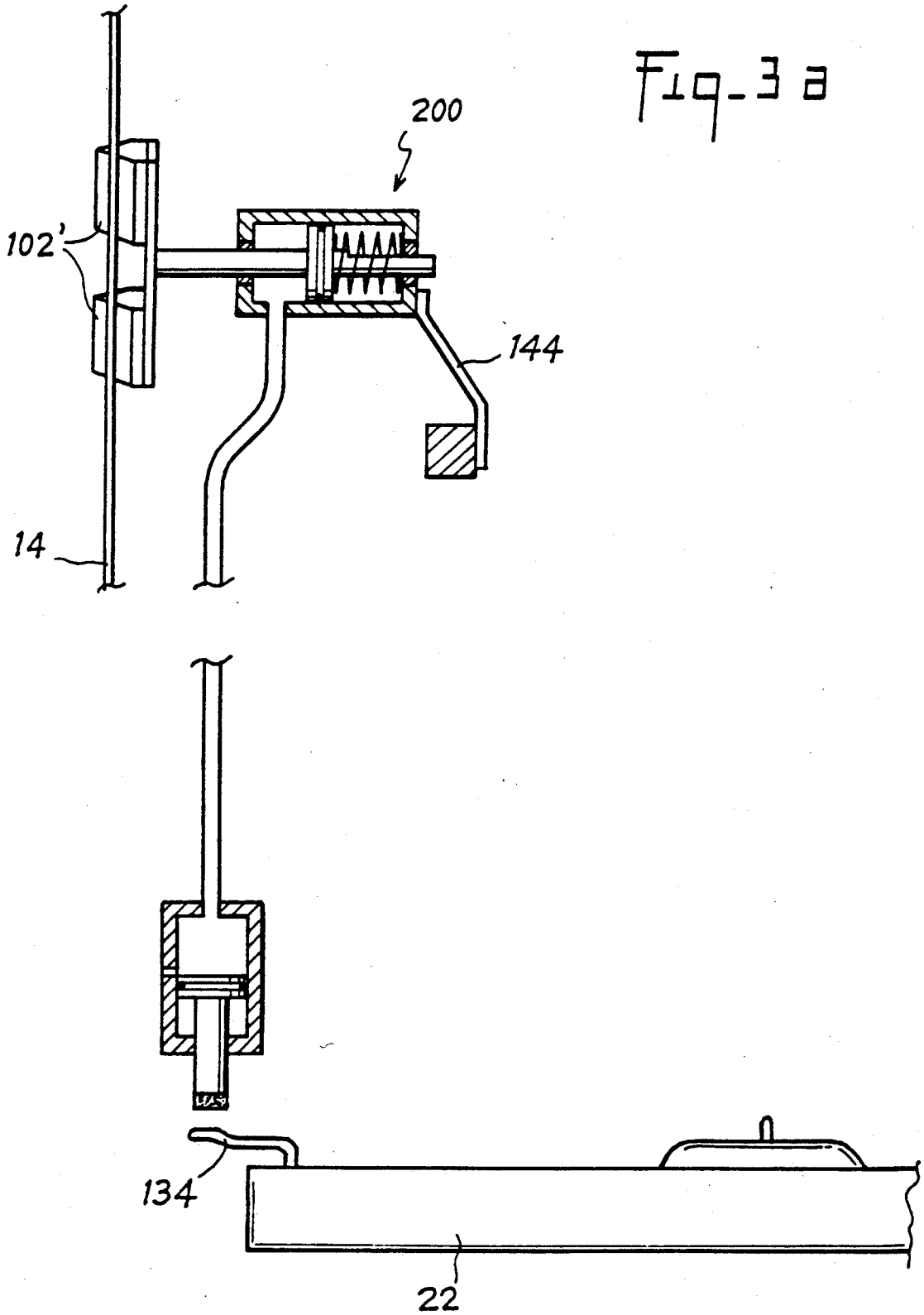
FIGS. 3*a* and 3*b* are detailed views of variant embodiments of the damper mechanism showing a hydraulic or pneumatic member (FIG. 3*a*) or an electromagnetic member (FIG. 3*b*).
Figure 3B:
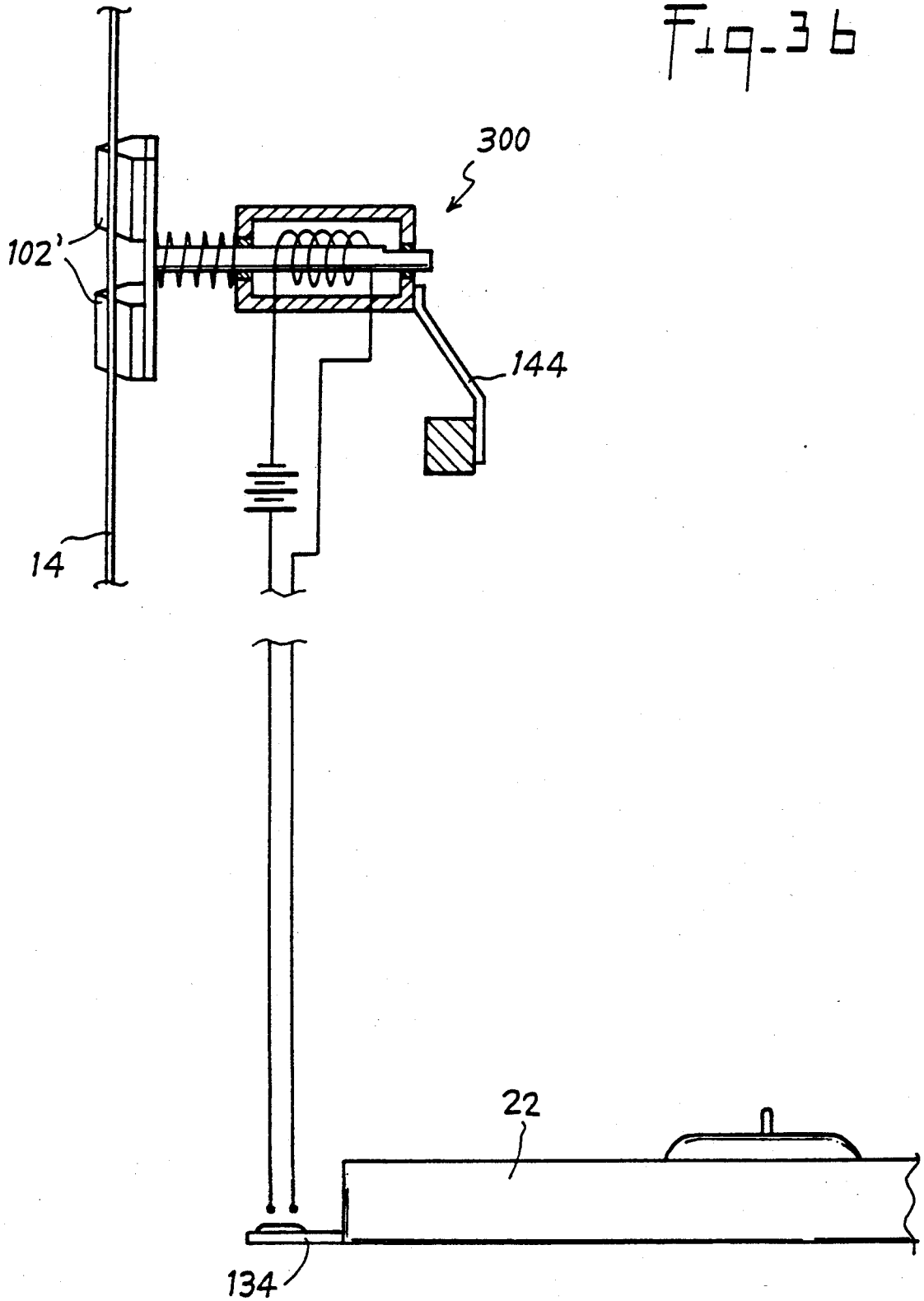

Finally, it is also possible to provide for the guide stem of the damper to be moved via an electromagnetic member 300 (see FIG. 3*b*), hydraulic or pneumatic members 200 (see FIG. 3*a*), as will be evident to anyone skilled in the art.

According to another embodiment incorporating a mechanical arrangement, a sheathed-cable control (204 see FIG. 1*a*) may be used.

Advantageously, the members interposed between the key and the damper guide stem will comprise no spring members in order not to affect the quality of the touch of the piano.

What is claimed is:

1. A damper mechanism for use in an upright piano, the upright piano provided with a plurality of strings disposed in a vertical plane, a plurality of moveable keys, each associated with one of the strings, and further, each key provided with an actuating end and a hand operatable end, the piano also provided with a plurality of pedals, including a sostenuto pedals, and a plurality of hammers, each hammer interposed between a single key and a single string, each of the hammers provided with a mechanism controlling a movement of hammer based upon striking the hand operatable end of its associated key, said damper mechanism associated with each of the strings, each individual damper mechanism comprising:

a damper wood;

a damper felt mounted on said damper wood;

a guide stem having a first end connected to said damper wood and directionally adjusted perpendicularly to the plane of the strings, said guide stem additionally provided with a second end;

a block containing a bore therein, said block provided on a fixed support, said block allowing said second end of said guide stem to move reciprocally within said bore; and a damper guide having an upper end connected with said block and a lower end provided above and in proximity with the actuating end of only the keys for reciprocally moving said guide stem in response to the movement of the key, and independent upon the movement of the hammer.

2. The damper mechanism in accordance with claim 1, further including an actuating mechanism connected to the sostenuto pedal for movement of said guide stem reciprocally in said bore independent of the mechanism controlling the movement of the hammer.

3. The damper mechanism in accordance with claim 1 wherein said damper guide is provided with a vertical rail and a plurality of eyelets for vertically guiding the movement of said damper guide, said lower end of said damper guide provided with a load and said upper end of said damper guide provided with an articulation, and wherein said block is provided with a rocking member having a first arm cooperating with said guide stem and a second arm, said rocking member pivotally mounted on said block, said damper mechanism further provided with said articulation connected between said upper end of said damper guide and said second arm of said rocking member.

4. The damper mechanism in accordance with claim 3, wherein said first arm of said rocking member is substantially vertical and said second arm of said rocking member is substantially horizontal.

5. The damper mechanism in accordance with claim 3, wherein said vertical rail is provided with a support which is independent of the hammer mechanism and wherein said fixed support for said block is also independent of the hammer mechanism.

6. The damper mechanism in accordance with claim 3 wherein a spoon is fixedly attached to the actuating end of the key in close proximity to said load.

7. The damper mechanism in accordance with claim 3 wherein said lower end of said damper guide including said load extends under the actuating end of the key.

8. The damper mechanism in accordance with claim 2, wherein said damper guide is provided with a lug and said actuating mechanism comprises a pivotally mounted control bar provided with a lateral tip, said control bar being controlled by said sostenuto pedal of the piano.

9. The damper mechanism in accordance with claim 1, wherein said guide stems is reciprocably moved by electromagnetic, pneumatic or hydraulic members.

10. The damper mechanism in accordance with claim 1, wherein said damper guide is provided in a sheathed cable.

11. The damper mechanism in accordance with claim 1, wherein said block contains a horizontal bore, allowing said guide stem to move horizontally within said bore, thereby moving said damper felt and said damper wood only in a direction perpendicular to the strings.

12. The damper mechanism in accordance with claim 2, wherein said block contains a horizontal bore, allowing said guide stem to move horizontally within said bore, thereby moving said damper felt and said damper wood only in a direction perpendicular to the strings.

* * * * *